US008261474B2

(12) United States Patent
Massullo

(10) Patent No.: US 8,261,474 B2
(45) Date of Patent: Sep. 11, 2012

(54) PACKAGED TOILET LID APPLIQUES

(76) Inventor: Celeste Massullo, Macedonia, OH (US)

( * ) Notice: Subject to any disclaimer, the term of this patent is extended or adjusted under 35 U.S.C. 154(b) by 1464 days.

(21) Appl. No.: 11/485,941

(22) Filed: Jul. 13, 2006

(65) Prior Publication Data

US 2007/0014959 A1 Jan. 18, 2007

Related U.S. Application Data

(60) Provisional application No. 60/699,000, filed on Jul. 13, 2005.

(51) Int. Cl.

| | |
|---|---|
| ***G09F 7/12*** | (2006.01) |
| ***G09F 3/10*** | (2006.01) |
| ***G09F 7/00*** | (2006.01) |
| ***G09F 3/04*** | (2006.01) |

(52) U.S. Cl. ..... 40/594; 40/673; 40/638; 40/595; 40/630; 4/661

(58) Field of Classification Search ..... 40/594, 40/673, 638, 595, 630; 4/661
See application file for complete search history.

(56) References Cited

U.S. PATENT DOCUMENTS 4,032,679 A * 6/1977 Aoyagi ..... 428/42.3
5,318,327 A * 6/1994 Daneshvar ..... 283/117
5,534,320 A * 7/1996 Raby ..... 428/42.1
5,662,976 A * 9/1997 Popat et al. ..... 428/40.1
6,382,676 B1 * 5/2002 Cochran et al. ..... 283/51

FOREIGN PATENT DOCUMENTS

JP 2004307211 A * 11/2004

* cited by examiner

*Primary Examiner* — Lesley D Morris
*Assistant Examiner* — Syed A Islam
(74) *Attorney, Agent, or Firm* — James C. Scott; Roetzel & Andress

(57) ABSTRACT

Packaged decorative thin-film appliqués for the exterior surface of toilet seat lids have a backer panel with a back side and an opposing release side, the release side having a release layer opposite the back side, the decorative thin-film appliqué having an application side facing and in contact with the release layer of the backer card, and a decorative side opposite the application side, the decorative side bearing printed images or indicia, and an appliqué frame substantially surround the decorative thin-film plastic appliqué and in contact with the release layer of the backer panel, the appliqué frame bearing printed images or indicia different from the decorative thin-film appliqué, and a separation between the decorative thin-film appliqué and the appliqué frame at which the decorative thin-film appliqué is separable from the backer panel with the appliqué frame remaining on the backer panel. A pre-packaged appliqué for hygienic and decorative use on a toilet set lid is thus provided for retail sales.

11 Claims, 4 Drawing Sheets

PACKAGED TOILET LID APPLIQUES

RELATED APPLICATION

This application is a conversion of U.S. provisional application No. 60/699,000, filed Jul. 13, 2005.

FIELD OF THE INVENTION

The present invention is in the general field of manufactured materials and more particularly materials in sheet form for use as protective and decorative coverings or laminates.

BACKGROUND OF THE INVENTION

Plastic film materials have been used as coverings and laminates in a wide variety of applications. They are useful as permanent or temporary protective and decorative layers on all different types of products and surfaces. Thin film plastics and polymers, such as polyurethane, can be bonded to the same or dissimilar materials by adhesive or by static electricity, i.e. static cling, in which case the thin film may be readily removable from the underlying surface. Advanced polymer technology has provided a large assortment of thin films available with desirable properties such as tear and scuff resistance, dimensional stability (resistance to stretching), flex and pliability, scalable gauge or mil sizes, printability, and the ability to accept additives in the polymer matrix.

Thin film polymer material is commercially produced in large continuous rolls which are then delivered to end product manufacturers and users for further processing, cutting and application. When the base material is mass produced in this manner, it is difficult to package sheet-form products for individual retail sales. Although roll-form packaging is an option, it has the disadvantages of susceptibility to damage and, for printed and decorative products, concealment of the printed designs and patterns. Retail products which are in rolled form also take up more shipping and display volume and space than flat sheet products.

For household applications, thin-films have been used as decorative and protective layers for shelf and wall coverings and window draft insulation, but have not been fully exploited for all decorative and protective and hygienic applications.

SUMMARY OF THE INVENTION

The disclosure is a decorative appliqué which is used to cover the lid of a toilet seat in the form of a packaged product with a backer panel and an appliqué frame which substantially surrounds the appliqué. In one form, the appliqué is made of a thin-film polymer of static cling vinyl material and in at least two standard shapes, an elongated u-shape (12" wide×15" long) and a round u-shape (12" wide×13.5" long). The appliqué can also be made in other shapes for application to other parts or surfaces of any type of toilet, including the toilet bowl, tank and the accompanying lids, covers and seats.

In one form, the invention provides a decorative cover for a toilet seat lid. The graphic designs on the appliqué material may be of any type, including but not limited to for example holiday themes, floral, seasonal and whimsical themes, etc., as shown in the accompanying Figures. The designs can be printed in color, black and white, glow-in-the-dark, metallic, etc. Fragrance or other additives can be impregnated in the appliqué material or applied topically. Another embodiment provides a toilet training chart for children in the form of a graphic design on the appliqué or otherwise topically applied, and accompanying reward stickers. The chart has on in empty spaces where the child, after performing the desired behavior, applies a sticker to one of the spaces on the chart. The chart can also be used with markers, such as erasable or water-based markers. The toilet training chart not only provides the child with an immediate connection between the desired behavior and the reward, but also teaches the child to put down the toilet lid when finished.

When executed with static cling vinyl material the appliqués are hygienic because they can be easily wiped clean while on or off the toilet seat lid. The vinyl material is applied to the lid by smoothing or rubbing it, either wet or dry, design side up. The vinyl material can be removed by simply peeling it off with no damage to the toilet seat lid and can be reapplied when desired. Different types of adhesive can also be used. Vinyl and other flexible plastic sheet materials can also be made in a wide variety of colors which serve as background colors for graphics applied to the sheet material by print or other means. Plastic sheet material can also be impregnated with fragrance and/or anti-microbial or anti-bacterial agents such as Mircoban®.

The invention thus provides functional appliqués which are specifically configured for application to various parts of toilets including toilet seats, and which bear graphics for aesthetic purposes and/or functional purposes.

DESCRIPTION OF REPRESENTATIVE EMBODIMENTS

Figure 1:
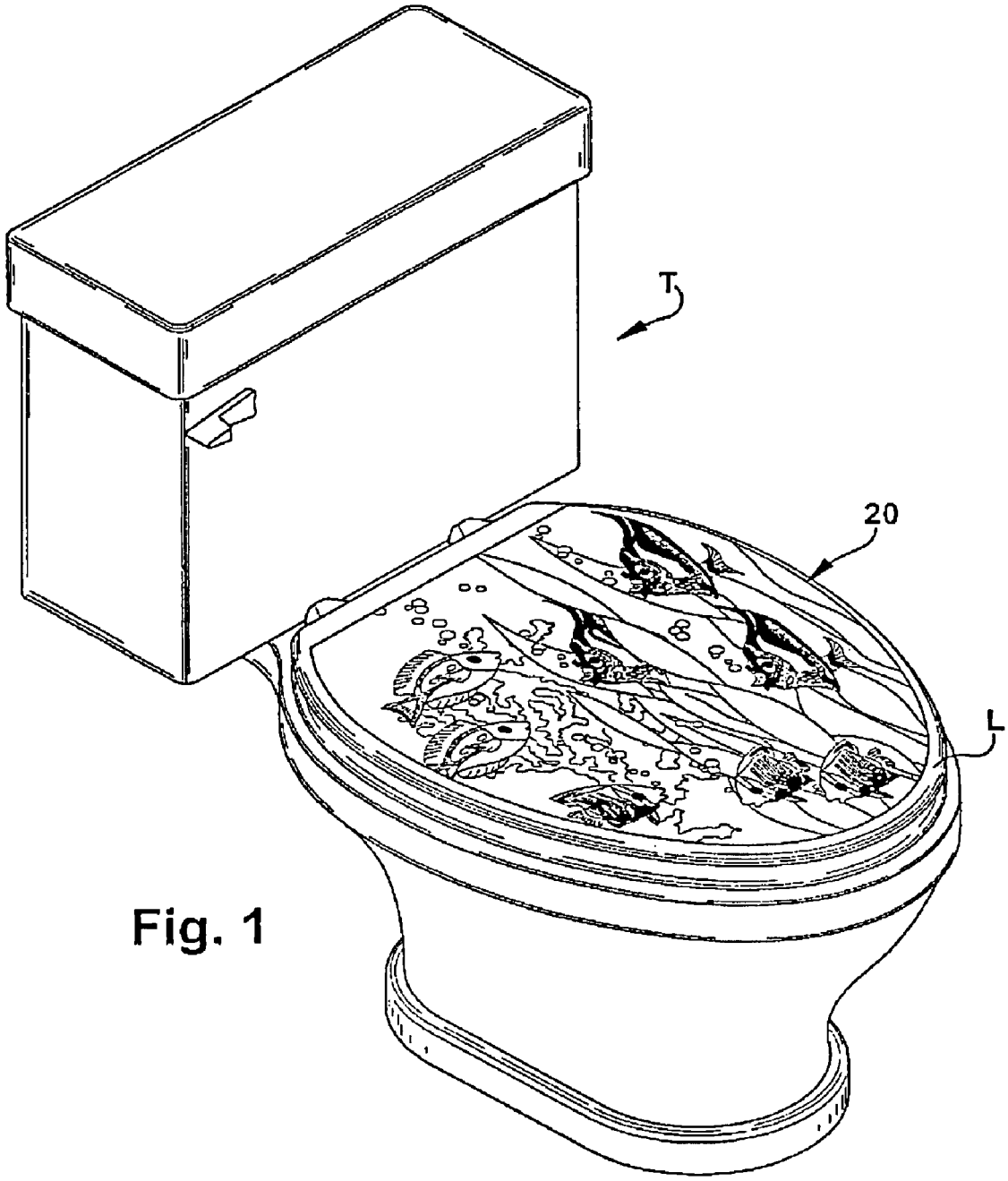
FIG. 1 illustrates a type of toilet lid appliqué of the disclosure as applied to a toilet lid.
Figure 2:
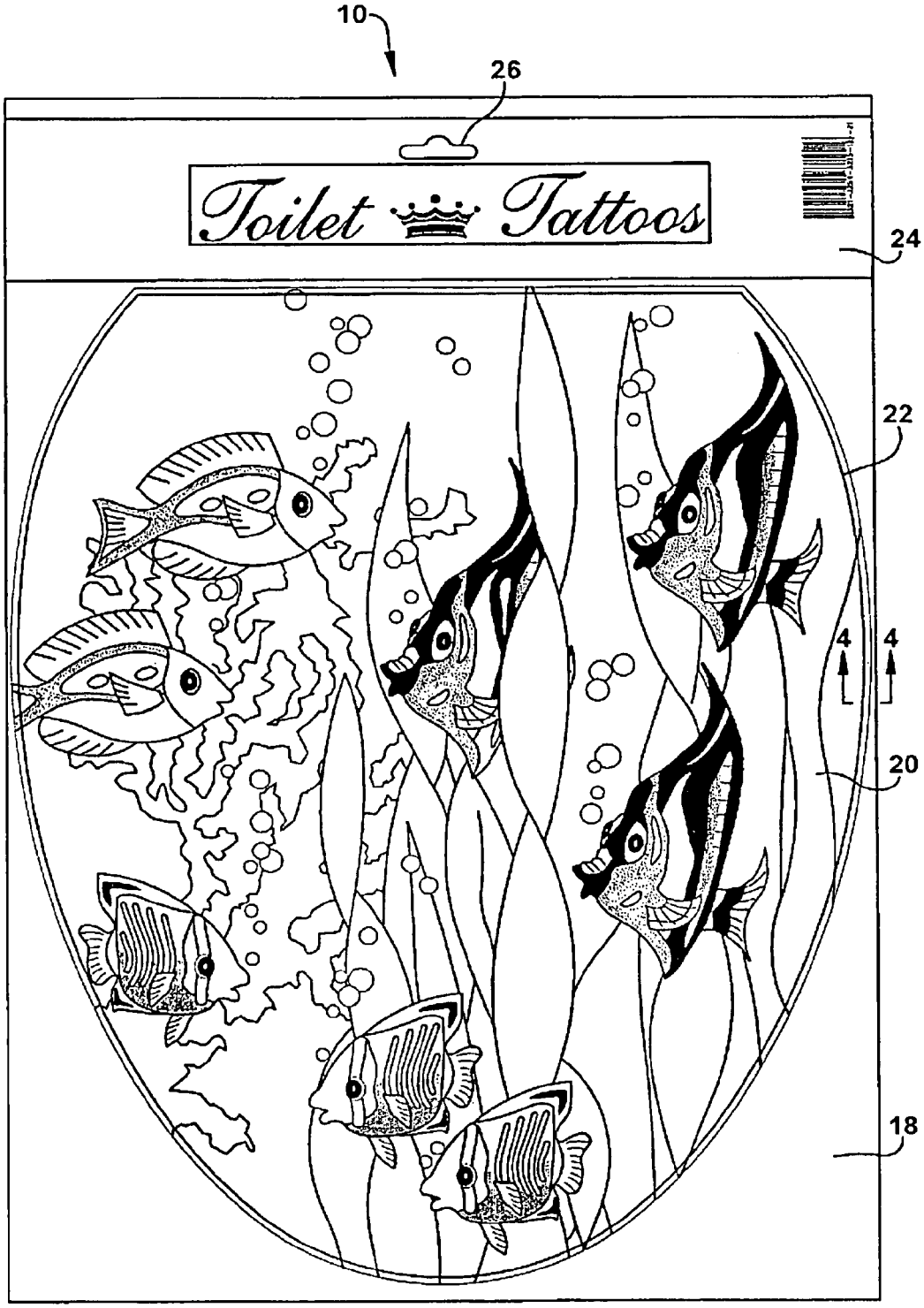
FIG. 2 illustrates a packaged toilet lid appliqué of the disclosure.
Figure 3:
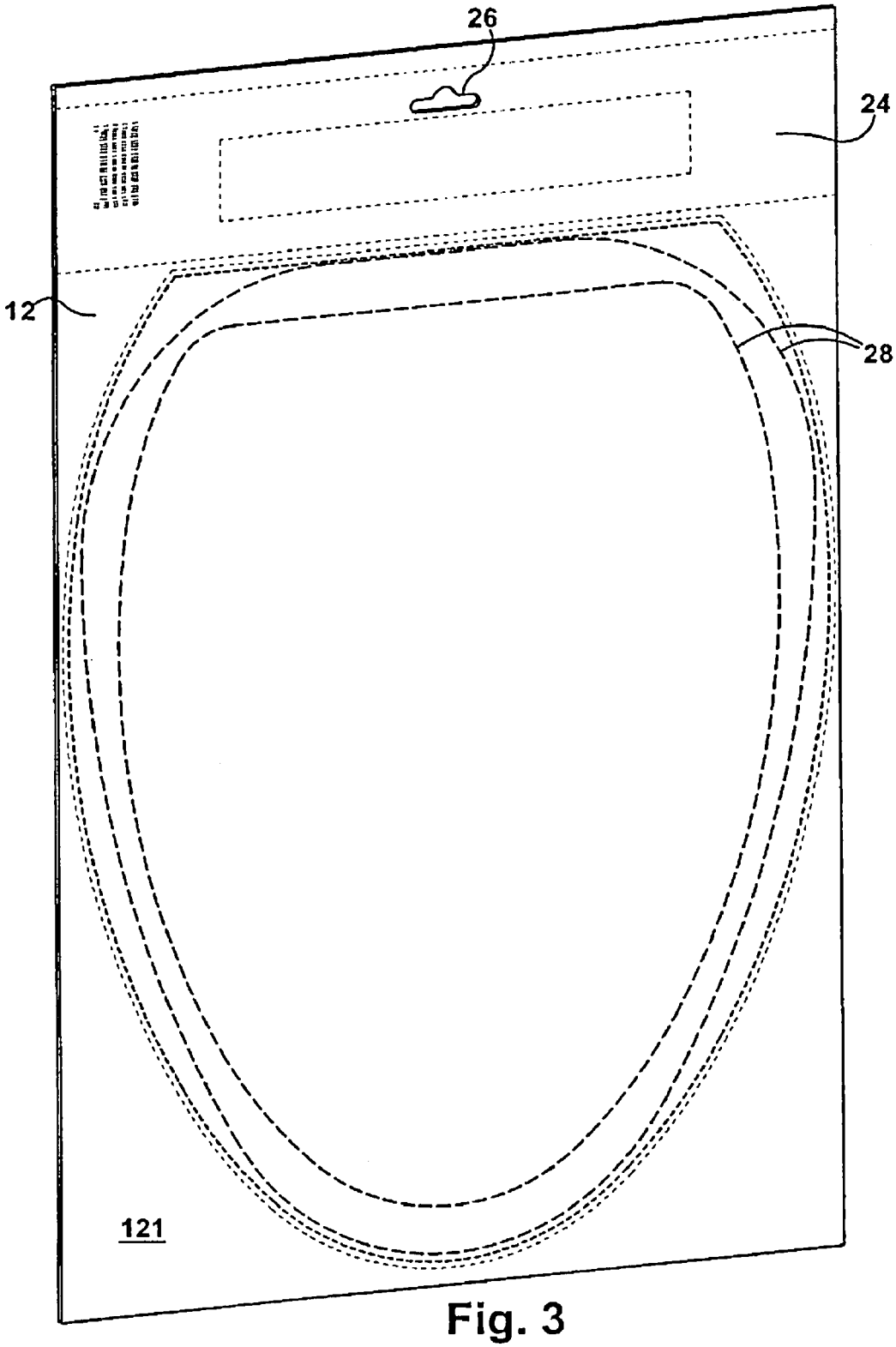
FIG. 3 illustrates a back side of a backer panel of the packaged toilet lid appliqué of the disclosure.

As shown in the Figures, a packaged decorative thin-film plastic appliqué is referenced in its entirety at 10 in FIG. 2, and in FIG. 1 an appliqué 20 of the product 10 as applied to a lid L of a toilet T. The packaged product includes a backer panel 12, which in one form may be a paper, fiber or polymeric sheet of sufficient weight, density and gauge to support the additional layers of the product as further described. The backer panel 12 has a back side 121 and a front side 122. The front side 122 supports or functions as a release layer 14. When the backer panel 12 is made of paper or fiber or pulp-containing material, a polymeric release layer 14 is applied to the front side 122. If the backer panel 12 is polymeric, then the front side 122 may serve as the release layer 14 without an additional or distinct layer of material applied. Further, the front side 122 of the backer panel 12 may be treated or coated with a material which functions as a release layer. Also, depending on the type of bonding mechanism between the backer panel 12 and the decorative thin-film plastic appliqué, the surface properties of the back side 121 and front side 122 of the backer panel 12 may or may not be similar or the same.

Positioned against the release layer 14 is a thin-film polymer layer 16, such as for example polyvinyl chloride (PVC) film, which extends over substantially all of the surface area of the release layer 14 and backer panel 12. The appliqué 20 and appliqué frame 18, shown in FIG. 2, are made from the thin-film polymer layer 16. A separation 22 is made in the thin-film polymer layer 16 between the appliqué frame 18 and the appliqué 20. In one form, the separation 22 is in the form of a cut through the thin-film polymer layer 16, such as can be made by a kiss cut type die, and without the separation extending into the release layer 14 or backer panel 12. In other forms, the separation 22 may be partial, such as perforation or indentation along a line of demarcation between the appliqué frame 18 and the appliqué 20. For the rounded and/or elongate shape of the appliqué 20 in various shapes and sizes for application to toilet seat lids, the appliqué frame 18 preferably extends at least the entire width and length of the appliqué 20 and, as shown in FIG. 2, greater than the width or length in at least one direction to form a package header 24 on which is printed product identification and information, such as instructions for use and UPC or other codes or markings for facilitation of retail sales. Because the appliqué frame 18 is fully supported by the backer panel 12, the entire product has adequate rigidity to be supported from a hanger opening 26 formed in the appliqué frame 18 and which extends through the backer panel 12; whereby multiple products can be supported in a stacked parallel arrangement upon a single hook or hanger extending from a vertical support as common in retail displays. Even without the package header 24, any portion of the appliqué frame 18 and underlying backer panel 12 serves as the packaging and support for the appliqué 20.

In one form, the appliqué 20 and appliqué frame 18 can be made of the same material, such as thin-film PVC sheet of 6.0 to 8.0 mils on a cast-coated liner such as Kromekote in 8 pt. or 10 pt. thickness as the backer panel 12 and release layer 14. The PVC film is preferably highly plasticized, calendered, flexible, dimensionally stable and non-topcoated, and clings statically to most clean glossy or semi-glossy surfaces without the need for adhesive. It is suitable for printing with most solvent and UV based inks, by solvent and conventional screen printing, UV offset lithography, UV flexography, solvent ink jet, thermal transfer, dye sublimation and electrostatic imaging with suitable transfer paper. The printability of the PVC thin-film enables combined printing of the appliqué 20 and appliqué frame 18 graphics and indicia in a single printing process. The applied print can be original artwork, graphic work and also photographs reproduced to make the images or indicia. Preferably, print which is applied to the edges of the appliqué 20 will extend beyond the separation 22 onto the adjacent area of the appliqué frame 18 to ensure full edge-to-edge printing on the appliqué 20 as an aesthetic feature. Other print or process-applied attributes to the appliqué 20 and/or appliqué frame 18 include holographic images, use of metallic inks or ink additives such as luminescents, application of foil layers and texturing. The material used for the appliqué 20 may be impregnated or treated with appropriate additives such as fragrance and/or anti-microbial or biocide agents such as Microban® to further enhance the sanitation aspects of the product.

The invention is not limited to the type of material used for any of the constituent parts, including the backer panel 12, release layer 14, the appliqué 20 and appliqué frame 18. Also, additional materials such as low-tack adhesive may be used in connection with the appliqué 20 as the primary bonding agent for application to the toilet lid surface. A paper embodiment has a paper-based backer panel 12 with a release layer and a separate paper layer from which the appliqué 20 and appliqué frame 18 are made and adhered to the release layer by an adhesive. As used herein, the term "thin-film" includes both plastic and paper materials.

Figure 4:
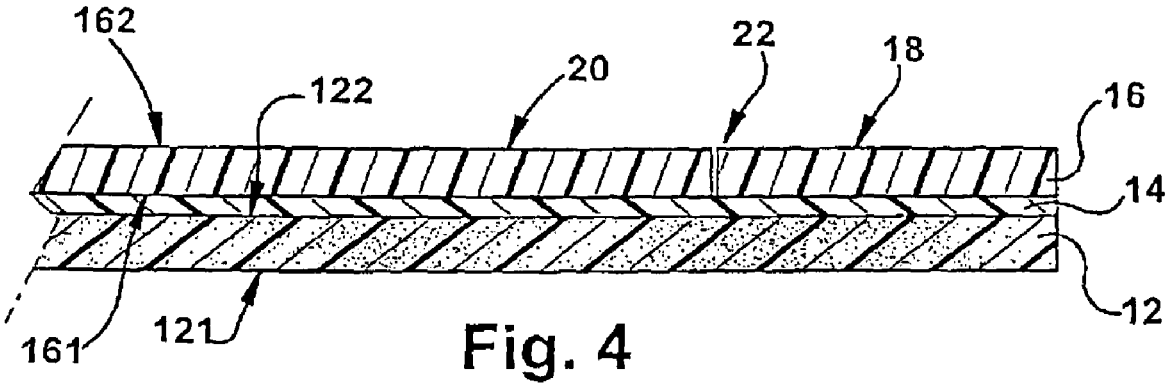
FIG. 4 illustrates a cross-section of the packaged toilet lid appliqué of the disclosure.

The product can be made in any size, but for use in connection with toilet seat lids of conventional western style toilets, in round and elongate configurations, representative dimensions for a round lid appliqué 20 can be 12 inches in width by 13.5 inches in length, on a backer panel 12 and corresponding appliqué frame 18 with dimensions of 12.5 inches in width and 17 inches in length; and for an elongate appliqué 20: 12 inches in width and 15 inches in length, on a backer panel 12 and corresponding appliqué frame 18 with dimensions of 12.5 inches in width and 18.5 inches in length. Also, the appliqué 20 and appliqué frame 18 may each be formed in more than one piece by additional separations or cuts made in the thin-film layer 16. As shown in FIG. 4, trimming guides 28 may be printed on the backside 121 of the backer panel 12 for trimming the appliqué 20 to different sizes and shapes. Alternatively, multiple separations or separation lines can be made in the layer 16 for different size and shape appliqués.

What is claimed as the invention is:

1. A packaged decorative and protective appliqué for a toilet lid comprising:

a paper-based backer panel with a back side and an opposing release side;

the packaged decorative and protective appliqué formed of the same material and in a common layer with an appliqué frame which substantially surrounds the packaged decorative and protective appliqué, the packaged decorative and protective appliqué and the appliqué frame being adjacent to and aligned with and in contact with the release side of the backer panel;

the packaged decorative and protective appliqué and the appliqué frame bearing print on a side opposite the release side of the backer panel, the print at least partially defining a package header on the appliqué frame, and multiple packaged decorative and protective appliqués in an aligned and parallel stack.

2. The packaged decorative and protective appliqué of claim 1 further comprising a hanger opening in the package header on the appliqué frame.

3. The packaged decorative and protective appliqué of claim 1 wherein the print includes a print pattern which extends from the packaged decorative and protective appliqué to the appliqué frame so that the print pattern extends to an edge of the packaged decorative and protective appliqué.

4. The packaged decorative and protective appliqué of claim 1 wherein the appliqué and appliqué frame are formed in a common layer of thin-film polymer material.

5. The packaged decorative and protective appliqué of claim 1 further comprising a separation between the appliqué and the appliqué frame.

6. The packaged decorative and protective appliqué of claim 1 wherein the print on the appliqué frame includes a UPC code.

7. The packaged decorative and protective appliqué of claim 1 wherein the print on the appliqué frame includes instructions for use of the appliqué.

8. The packaged decorative and protective appliqué of claim 1 further comprising a fragrance additive.

9. The packaged decorative and protective appliqué of claim 1 further comprising an anti-microbial additive.

10. The packaged decorative and protective appliqué of claim 1 further comprising one or more trim guides on a back side of the backer panel.

11. The packaged decorative and protective appliqué of claim 1 wherein a thickness or stiffness of the backer panel is substantially greater than a thickness or stiffness of the appliqué and appliqué frame.

* * * * *